United States Patent [19]

Bleasdale

[11] 4,207,825

[45] Jun. 17, 1980

[54] KNIFE ASSEMBLY FOR TUFTING MACHINES

[75] Inventor: Barrie Bleasdale, Oswaldtwistle, England

[73] Assignee: Edgar Pickering (Blackburn) Limited, Lancashire, England

[21] Appl. No.: 963,578

[22] Filed: Nov. 24, 1978

[30] Foreign Application Priority Data

Jan. 9, 1978 [GB] United Kingdom ..... 760/78

[51] Int. Cl.[2] ..... D05C 15/00

[52] U.S. Cl. ..... 112/79 R

[58] Field of Search ..... 112/79 R, 79 A, 79.5; 83/700

[56] References Cited

U.S. PATENT DOCUMENTS

| | | | |
|---|---|---|---|
| 3,277,852 | 10/1966 | Card | 112/79 R |
| 4,001,095 | 12/1977 | Price | 83/700 X |
| 4,009,669 | 3/1977 | Wear | 112/79 R |

*Primary Examiner*—Ronald Feldbaum

*Attorney, Agent, or Firm*—Watson, Cole, Grindle & Watson

[57] ABSTRACT

A knife assembly for a fine gauge tufting machine comprises a rectangular clamping bar and a series of knife blocks mounted side by side on the knife bar. Each knife block carries a number of knives mounted in parallel grooves in the knife block machined in a direction to present the knives to loopers of the machine at the desired cutting angle. The knives are retained in each knife block by a plate and clamping screws which extend through the plate to engage the edges of the knives. Each knife block has a rearwardly extending peg which is clamped in a hole in the knife bar with the knife block orientated to present the knives to the loopers at the desired pressing angle.

3 Claims, 4 Drawing Figures

KNIFE ASSEMBLY FOR TUFTING MACHINES

In a tufting machine which produces cut pile fabric it is necessary for the knives, which cut the loops of yarn held by the loopers, to be inclined to the loopers at a small cutting angle which is normally of the order of 4°. The knives are accordingly presented to the loopers at this angle as viewed in plan. It is also necessary for the knives to be presented to the loopers, viewed in elevation, at another angle herein termed the pressing angle, which is normally of the order of 10°. As the knives contact and move across the loopers their top portions bend through this small angle as they flatten against the loopers to provide cutting pressure.

The knife assembly in a tufting machine may be constituted by a rectangular knife bar carrying a number of contiguous knife blocks, each of which carries a peg which engages a hole in the knife bar drilled at the cutting angle of about 4° to the perpendicular to the front face of the knife bar, each knife block carrying one or more knives and being so oriented with respect to the knife bar that the knives are inclined to the knife bar at the pressing angle of about 10°. A knife assembly of this construction is described in my U.S. Application Ser. No. 858,027, U.S. Pat. No. 4,175,497.

The present invention provides a knife assembly for use in a fine gauge tufting machine, comprising a rectangular knife bar drilled with a series of equally spaced holes which extend perpendicular to its front face, a series of knife blocks, each carrying a peg on its rear face which is fitted into and clamped in a hole in the knife bar, a plurality of knives carried by each knife block, the knife blocks being mounted adjacent one another on the knife bar with the knives oriented to the knife bar at the same pressing angle $\alpha$, and the knives being accommodated in slots so machined into the knife blocks that the knives will be inclined at a small cutting angle $\beta$ to the loopers, clamping plates on the front faces of the knife blocks and clamping screws fitted into tapped holes in the clamping plates and engaging the edges of the knives.

This construction of knife block is suitable for use in a tufting machine having as fine a gauge as 1/16", i.e. a machine having the needles spaced by as small a distance as 1/16" on the needle bar. It has the advantage that the cutting angle is built into the knife blocks at the machining stage when the knife-accommodating slots are formed.

One embodiment of knife assembly according to the invention will now be described in detail, by way of example, with reference to the accompanying drawings, in which.

Figure 1:
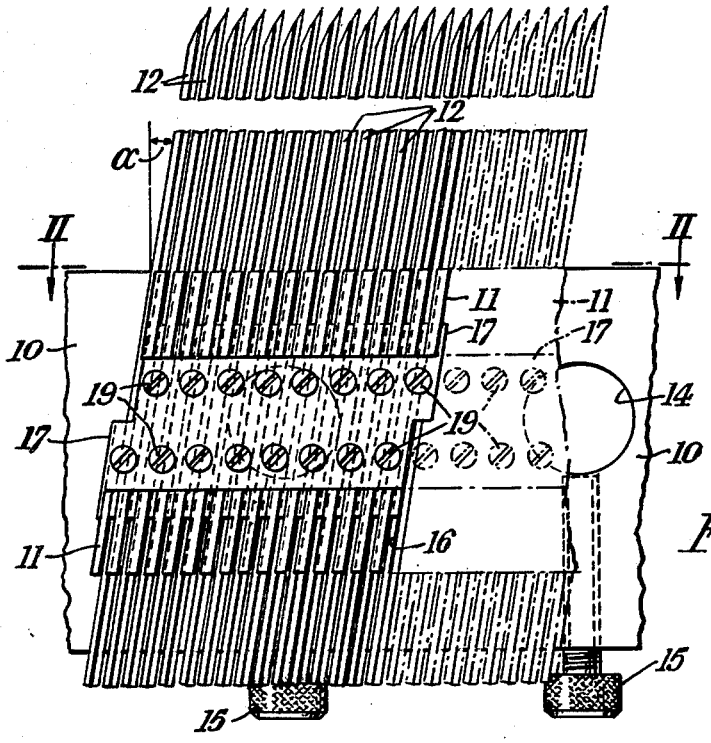
FIG. 1 is a front elevation of part of the assembly.
Figure 2:
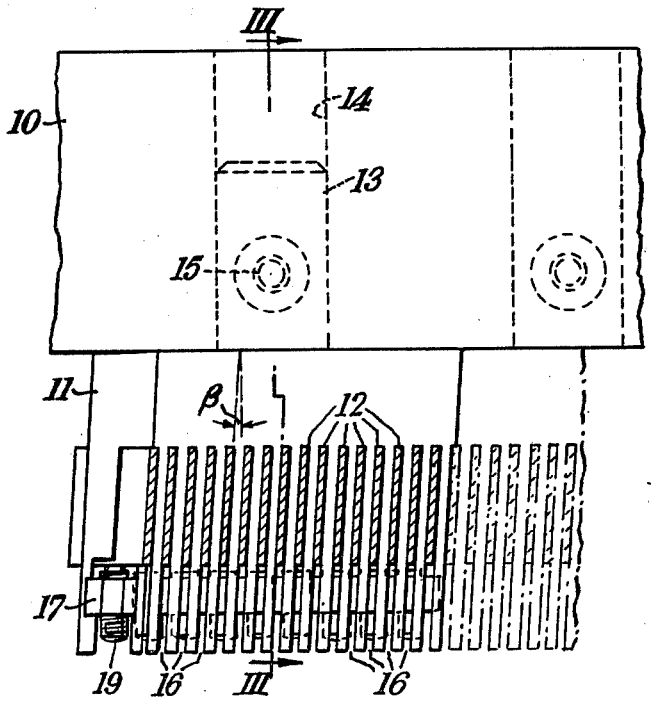
FIG. 2 is a section on the line II—II in FIG. 1.
Figure 4:
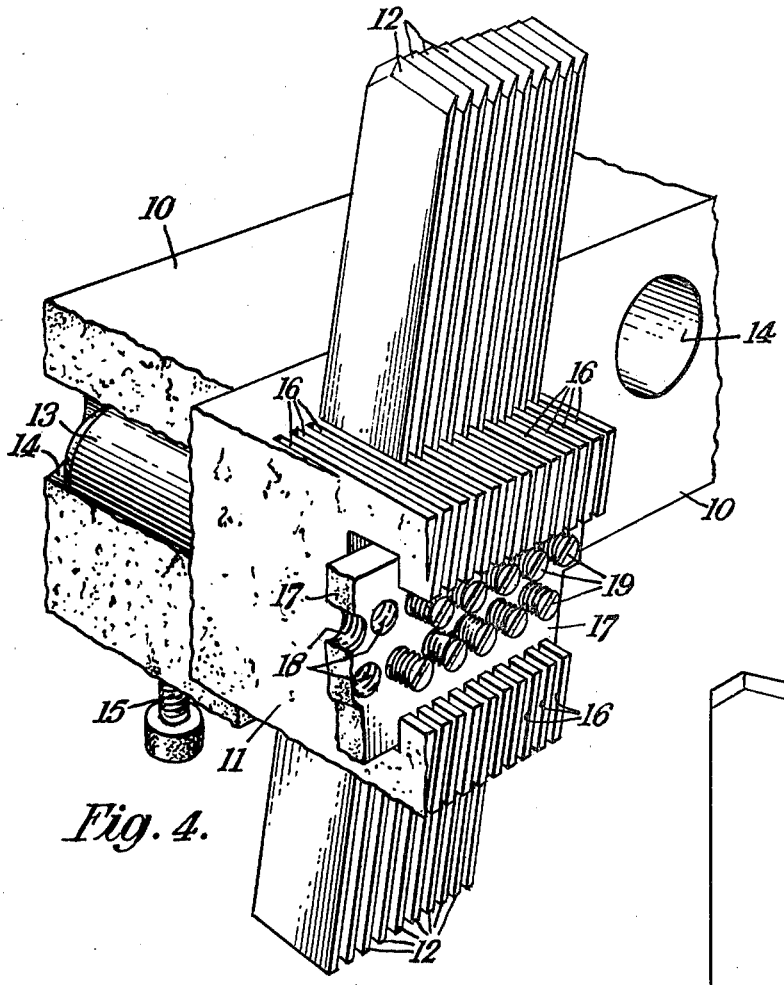
FIG. 4 is a perspective view.
Figure 3:
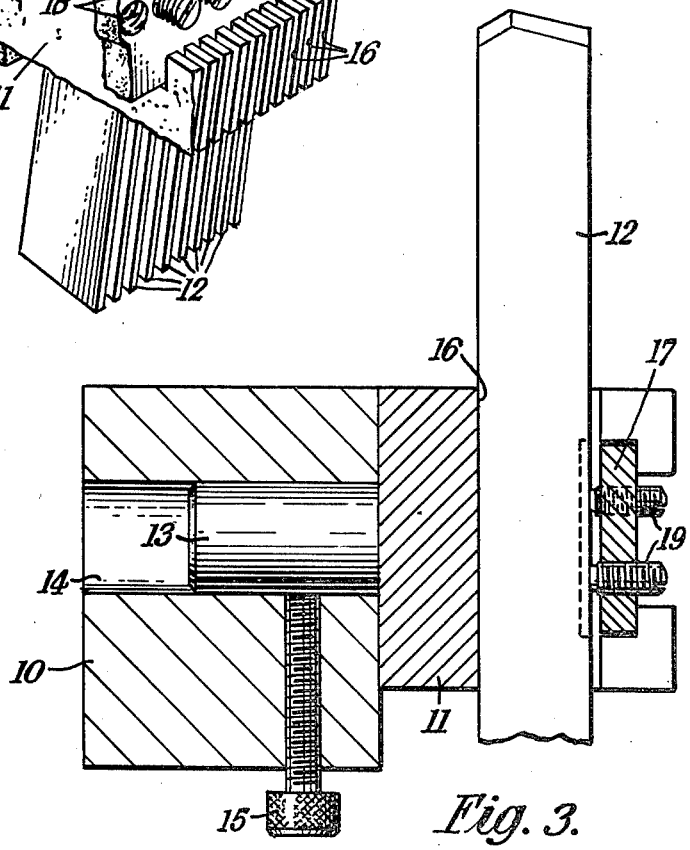
FIG. 3 is a section on the line III—III in FIG. 2.

As will be seen from the drawings, the knife assembly includes a rectangular knife bar 10 on which are mounted side by side a number of knife blocks 11, each of which carries a number of knives 12. In the case illustrated each knife block 11 carries sixteen knives. In use in a tufting machine, the knife bar 10 is oscillated in the well known manner to cause the knives 12 to cut loops of yarn retained on the loopers of the machine.

Each knife block 11 carries a rearwardly extending peg 13, which is accommodated in one of a series of equally spaced holes 14 drilled into the knife bar in a direction perpendicular to its front face. The pegs 13 are clamped in the holes 14 by individual clamping screws 15 with the knife blocks so positioned that the knives 12 are inclined to the knife bar 10 at the desired pressing angle $\alpha$, e.g. 10°.

The knives 12 are accommodated in parallel slots 16 in the knife blocks 11, the slots 16 being machined at an inclination such that the knives will be inclined to the loopers at the desired cutting angle $\beta$, e.g. 4°. The knives 12 are retained in each knife block 11 by a plate 17 formed with tapped holes 18 which accommodate two rows of clamping screws 19 which bear against the edges of the knives 12. The holes 18 are arranged in two rows because of the smallness of the gauge of the machine and therefore of the spacing of the knives 12. Holes of adequate size could not be drilled in a single row without breaking into one another. The screws 19 engaging the holes 18 in one row are accordingly staggered in relation to the screws engaging the holes in the other row. As a consequence the ends of the knife blocks 11 have offset upper and lower portions as shown.

The knife blocks 11 are mounted on the knife bar 10 with a slight clearance between them of a few thousandths of an inch. It is accordingly possible to reorientate them, if desired, to change the pressing angle $\alpha$ from 10° to, say, 8° or 12°, or an intervening angle, by slackening the clamping screws 15 which engage the pegs 13, rotating the pegs 13 to the desired new orientation and reclamping them.

What I claim as my invention and desire to secure by Letters Patent is:

1. A knife assembly for use in a fine gauge tufting machine, comprising a rectangular knife bar drilled with a series of equally spaced holes which extend perpendicular to its front face, a series of knife blocks, each carrying a peg on its rear face which is fitted into and clamped in a hole in the knife bar, a plurality of knives carried by each knife block, the knife blocks being mounted adjacent one another on the knife bar with the knives oriented to the knife bar at the same pressing angle $\alpha$, and the knives being accommodated in slots so machined into the knife blocks that the knives will be inclined at a small cutting angle $\beta$ to the loopers, clamping plates on the front faces of the knife blocks and clamping screws fitted into tapped holes in the clamping plates and engaging the edges of the knives.

2. A knife assembly according to claim 1, in which the holes in each plate are arranged in two rows, the clamping screws in one row of holes being staggered in relation to the clamping screws in the other row.

3. A knife assembly according to claim 1, wherein the knife blocks are mounted on the knife bar with a slight clearance between them.

* * * * *